US005287709A

United States Patent [19]

Seino et al.

[11] Patent Number: 5,287,709

[45] Date of Patent: Feb. 22, 1994

[54] STITCH DENSITY ADJUSTING DEVICE OF CIRCULAR KNITTING MACHINE

[75] Inventors: Masahiro Seino, Niigata; Kazuhiko Tamaki, Sanjo; Hidemasa Sakamoto, Niigata; Minoru Oboshi, Niigata; Yutaka Kaneuchi, Niigata, all of Japan

[73] Assignee: Nagata Seiki Kabushiki Kaisha, Tokyo, Japan

[21] Appl. No.: 979,182

[22] Filed: Nov. 20, 1992

[30] Foreign Application Priority Data

Nov. 21, 1991 [JP] Japan ..... 3-103669
Feb. 4, 1992 [JP] Japan ..... 4-19079
May 8, 1992 [JP] Japan ..... 4-116104

[51] Int. Cl.[5] ..... D04B 9/00
[52] U.S. Cl. ..... 66/55; 66/8
[58] Field of Search ..... 66/54, 55, 8

[56] References Cited

U.S. PATENT DOCUMENTS 1,612,736 12/1926 La Montagne ..... 66/55
2,911,808 11/1959 Routh et al. ..... 66/55
4,527,402 7/1985 Swallow et al. ..... 66/55
4,567,737 2/1986 Lonati ..... 66/55

FOREIGN PATENT DOCUMENTS 1032874 6/1958 Fed. Rep. of Germany ..... 66/55
1233528 2/1967 Fed. Rep. of Germany ..... 66/55
58140 9/1953 France ..... 66/55
3-60942 9/1991 Japan .
1371190 10/1974 United Kingdom ..... 66/55

*Primary Examiner*—Clifford D. Crowder
*Assistant Examiner*—John J. Calvert
*Attorney, Agent, or Firm*—Ladas & Parry

[57] ABSTRACT

In a stitch density adjusting device of a circular knitting machine for knitting stockings, panty hose, tights and so on, a needle cylinder is moved up and down for adjusting the density of the stitches being formed. In order to move the needle cylinder up and down, a knitting control unit having a knitting program set therein supplies a control signal to a reversible pulse motor which causes the needle cylinder to move through a movement transmission mechanism. The temperature rise in the knitting head due to friction is detected by sensor in the head and compared with a set value in a comparator which delivers a temperature difference signal to the knitting control unit. The control unit operates to compensate for the temperature rise by controlling the pulse motor.

9 Claims, 8 Drawing Sheets

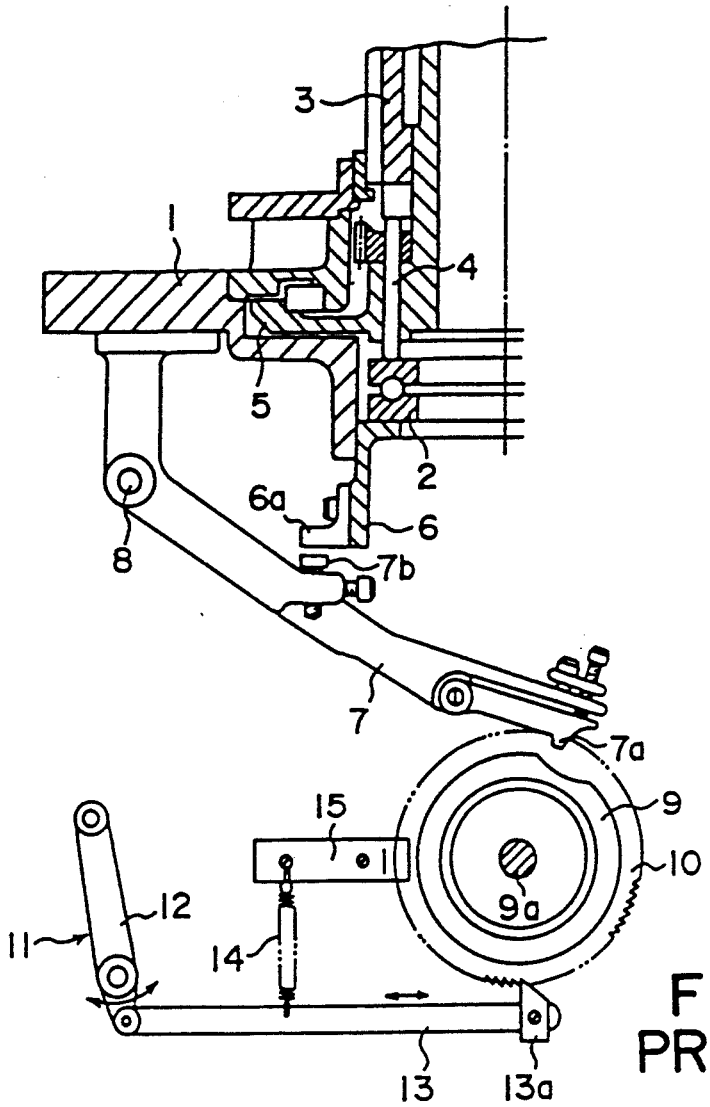
FIG. 8
PRIOR ART
FIG. 9A
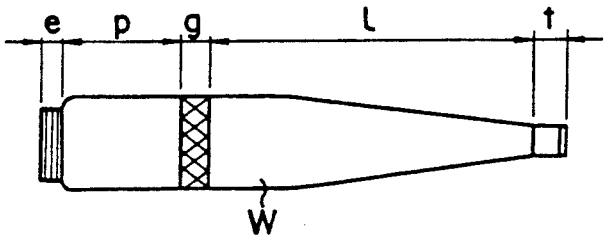
FIG. 9B
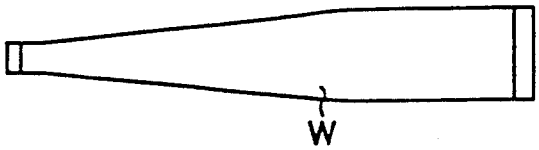
FIG. 9C
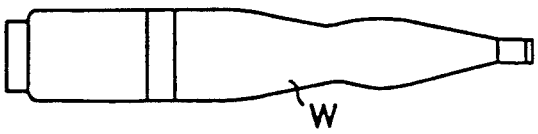

STITCH DENSITY ADJUSTING DEVICE OF CIRCULAR KNITTING MACHINE

BACKGROUND OF THE INVENTION

This invention relates to a stitch density adjusting device of a circular knitting machine for knitting stockings, panty hose, tights and the like.

A conventional circular knitting machine of the above kind comprises a needle cylinder carrying a number of knitting needles in a vertically displaceable manner. In order to enable varying of the density of stitches produced by the knitting machine, there is provided a stitch density adjusting device. For varying the stitch density, a fashioning cam and a stitch density adjusting lever are provided. The fashioning cam acts on an end of the stitch density adjusting lever to cause it to swing vertically about a pivot. There is provided a rising ring below the knitting cylinder. The stitch density adjusting lever acts on the rising ring via an abutment piece as the lever swings vertically, thereby raising and lowering the needle cylinder through the rising ring and rising pins provided between the needle cylinder and the rising ring, whereby the density of stitches of the knitted yarn is changed or adjusted as will be described in more detail hereinafter.

By adjusting the stitch density gradually in the manner as described above, a knitted fabric having a gradually changing circumference is obtained depending upon the contour of the fashioning cam. For example, a panty hose having a gradually decreasing circumference from a welt portion to an ankle portion can be knitted.

With the type of stitch density adjusting device described above, the fashioning cam must be replaced with another fashioning cam in order to knit a product having a gradually increasing circumference or an irregularly changing circumference. Furthermore, it is very difficult to knit a product having an irregularly changing circumference with the conventional stitch density adjusting device using the fashioning cam.

Circular knitting machines of the type described above are operated at high speed and the needle cylinder is rotated, for example, at 200 to 1500 RPM, for the purpose of improving the operating efficiency.

This causes a problem of the needle cylinder and its associated parts are heated up to about 70° to 80° C. due to frictional resistance in continuous operation. As the needle cylinder and the associated parts are subjected to temperature rise, they undergo thermal expansion which is of the order of 0.15 to 0.2 mm in the axial direction of the needle cylinder. The thermal expansion undesirably causes elongation of the knitted products of the order of 10 to 15% of the standard knitted length.

SUMMARY OF THE INVENTION

It is an object of the present invention to provide a stitch density adjusting device of a circular knitting machine, which can solve the above stated problems.

An object of the present invention is to provide a stitch density adjusting device of a circular knitting machine, wherein knitted products having any changes in circumference can be knitted without replacing the fashioning cam.

A further object of the present invention is to provide a stitch density adjusting device of a circular knitting machine, wherein undesirable elongation of the knitted products due to frictional heat can be prevented.

A still further object of the present invention is to provide a stitch density adjusting device of a circular knitting machine, wherein a fine adjustment of the stitch density can be made.

According to the present invention, there is provided a stitch density adjusting device of a circular knitting machine having a needle cylinder, a knitting head provided outside the needle cylinder, and means for moving the needle cylinder up and down for stitch density adjustment, the device comprising reversible motor means for actuating the means for moving the needle cylinder up and down, and knitting control means having a stitch density control program set therein for controlling the motor means in accordance with the stitch density control program.

The nature and utility of the present invention will become more apparent from the description of preferred embodiments of the present invention with reference to the accompanying drawings.

BRIEF DESCRIPTION OF THE DRAWINGS

FIG. 8 is an elevational view, partly in section, showing a known stitch density adjusting device; and FIGS. 9A, 9B and 9C are views showing different knitted products.

DESCRIPTION OF THE PREFERRED EMBODIMENTS

Figure 1:
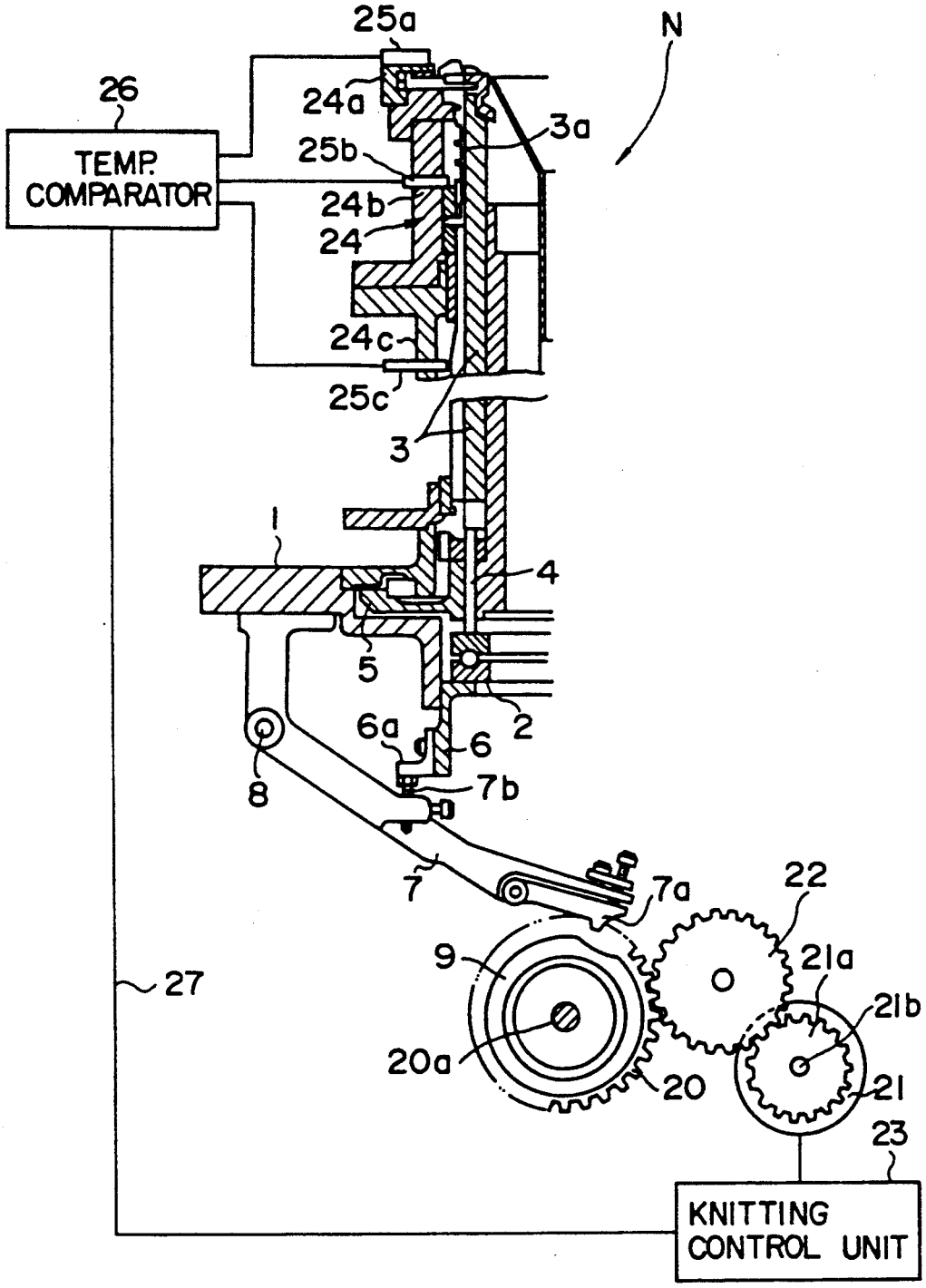
FIG. 1 is a fragmentary view, partly in vertical section, of a circular knitting machine provided with a stitch density adjusting device according to the present invention.

Before proceeding with a description of preferred embodiments of the invention, the known stitch density adjusting device described hereinbefore will be described with reference to the drawings for a better understanding of the prior art and its attendant problems described before.

FIG. 8 shows a stitch density adjusting device of the conventional circular knitting machine.

The circular knitting machine 1 comprises a frame 1. The frame 1 includes a bearing 2 having thereon a needle cylinder 3 supported vertically displaceably by way of rising pins 4 and rotatably through a bevel gear 5 connected with a drive source not shown. At the bottom of the bearing 2, there is further provided a rising ring 6 which is supported in such a manner that it is not allowed to fall out downward. The rising ring 6 has an abutment piece **6*a* mounted thereto. The frame 1 further includes a stitch density adjusting lever 7 pivotally mounted around a pivot 8. In the vicinity of one end 7*a*** of the stitch density adjusting lever 7, the frame 1 has a known fashioning cam 9 provided on a shaft 9a for rotation in contact with the one end 7a of the stitch density adjusting lever 7. In the middle of the stitch density adjusting lever 7, there is provided an abutting member 7b adapted to come into contact with the abutment piece 6a of the rising ring 6 for vertically raising and lowering the rising ring 6.

The fashioning cam 9 comprises a ratchet wheel generally designated at 10 and coaxially and integrally attached thereto. The ratchet wheel 10 is intermittently rotated by one tooth pitch with the aid of a racking mechanism (intermittent feed mechanism) 11 pivotally mounted on the frame 1. The racking mechanism 11 consists of a racking lever 12, a feed bar 13 with a feed pawl 13a, and a coil spring 14 exerting a force to the feed bar 13. Additionally, a brake mechanism 15 is arranged on a part of the circumference of the ratchet wheel 10 so as to apply a braking force to the circumferential surface of the ratchet wheel 10.

In the case of knitting a panty hose W, for example, from the left to the right as shown in FIG. 9A by the use of the stitch density adjusting device described above, a predetermined fashioning cam 9 is previously selected and mounted on the shaft 9a, and then the circular knitting machine is operated at a knitting start position. As a result, there occurs an intermittent rotation of the ratchet wheel 10 by one teeth pitch by virtue of the racking lever 12 and the feed pawl 13a of the feed bar 13 with the coil spring 14 which constitute the racking mechanism (intermittent feed mechanism) 11. This permits the intermittent rotation of the fashioning cam 9 integral with the ratchet wheel 10, which in turn allows the stitch density adjusting lever 7 in contact with the fashioning cam 9 to be swung around the pivot 8. In consequence, the abutting member 7b on the stitch density adjusting lever 7 forces the abutment piece 6a of the rising ring 6 to rise and fall vertically. The rising ring 6 in turn vertically raises and lowers the revolving needle cylinder 3 by way of the bearing 2 and the rising pins 4, thereby knitting the panty hose W shown in FIG. 9A from the left to the right with knitting needles (not shown) on the needle cylinder 3 while changing the density of the stitches of the yarn which has been fed.

The hose are knitted with a gradual change in its circumference from an enlarged welt portion to a reduced ankle portion based on the configuration of the fashioning cam 9.

In this manner, the panty hose W shown in FIG. 9A is repeatedly and continuously knitted from the left to the right by the stitch density adjusting device described above.

Figure 2:
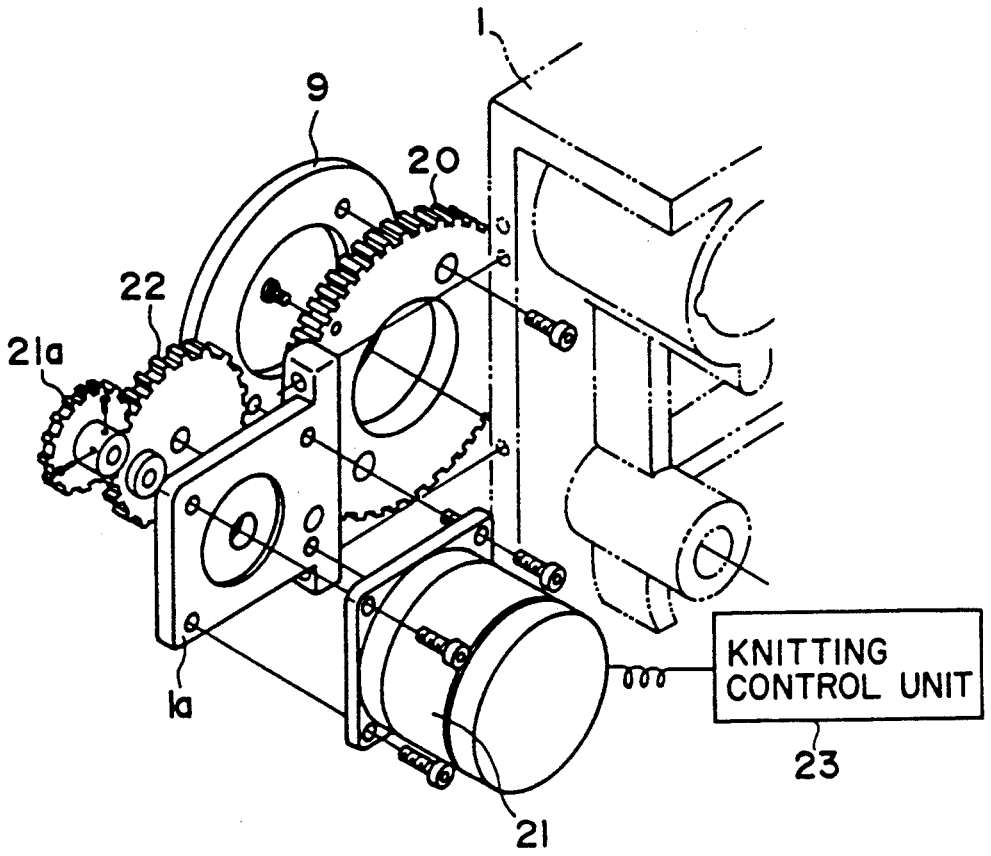
FIG. 2 is a fragmentary perspective view showing a part of FIG. 1.

The above stitch density adjusting device is intended to knit a standard hose having a progressive change in the circumference from the enlarged welt portion to the reduced ankle portion depending on the contour of the fashioning cam 9. Therefore the fashioning cam 9 must be replaced with a fashioning cam having a reversely changing contour in order to knit a panty hose of patched style of which the circumference changes oppositely as shown in FIG. 9B. Furthermore, it is extremely difficult to knit a panty hose as shown in FIG. 9C, of which the righthand portion has an irregular shape matching the shape of the leg Referring now to FIG. 1, a stitch density adjusting device shown therein can solve the problems described above. A bearing 2 provided on a frame 1 of a circular knitting machine N supports a needle cylinder 3 vertically displaceably through rising pins 4 and rotatably by way of a bevel gear 5. Below the bearing 2, there is provided a rising ring 6 having an abutment piece 6a fixed thereto. The frame 1 further includes a stitch density adjusting lever 7 pivotally mounted around a pivot 8. In close proximity of one end 7a of the stitch density adjusting lever 7, there is a known fashioning cam 9 provided on the frame 1 in such a manner that the cam 9 is rotated while being in contact with the one end 7a of the stitch density adjusting lever 7. Moreover, an abutting member 7b is located in the middle of the stitch density adjusting lever 7 to allow the abutment piece 6a on the rising ring 6 to be vertically raised and lowered. The fashioning cam 9 further includes a drive gear 20 provided coaxially and integrally therewith on a shaft 20a. The drive gear 20 meshes through an intermediate gear 22 with a pinion 21a secured to an output shaft 21b of a pulse motor 21. The pinion 21a, intermediate gear 22 and drive gear 20 constitute a speed reduction mechanism. The pulse motor 21 is horizontally mounted on a vertically extending retaining plate 1a of the frame 1 as shown in FIG. 2. Furthermore, the pulse motor 21 is connected to a knitting control unit 23 which stores a knitting program. The pulse motor 21 is rotated forwardly and reversely based on a control signal derived from the knitting program of the knitting control unit 23. That is, the knitting program of the knitting control unit 23 comprises a standard program for knitting a panty hose with a gradual change in circumference from the enlarged welt portion to the reduced ankle portion, as well as a program according to which hose having a free configuration from the welt portion to the ankle portion can be knitted.

Figure 3:
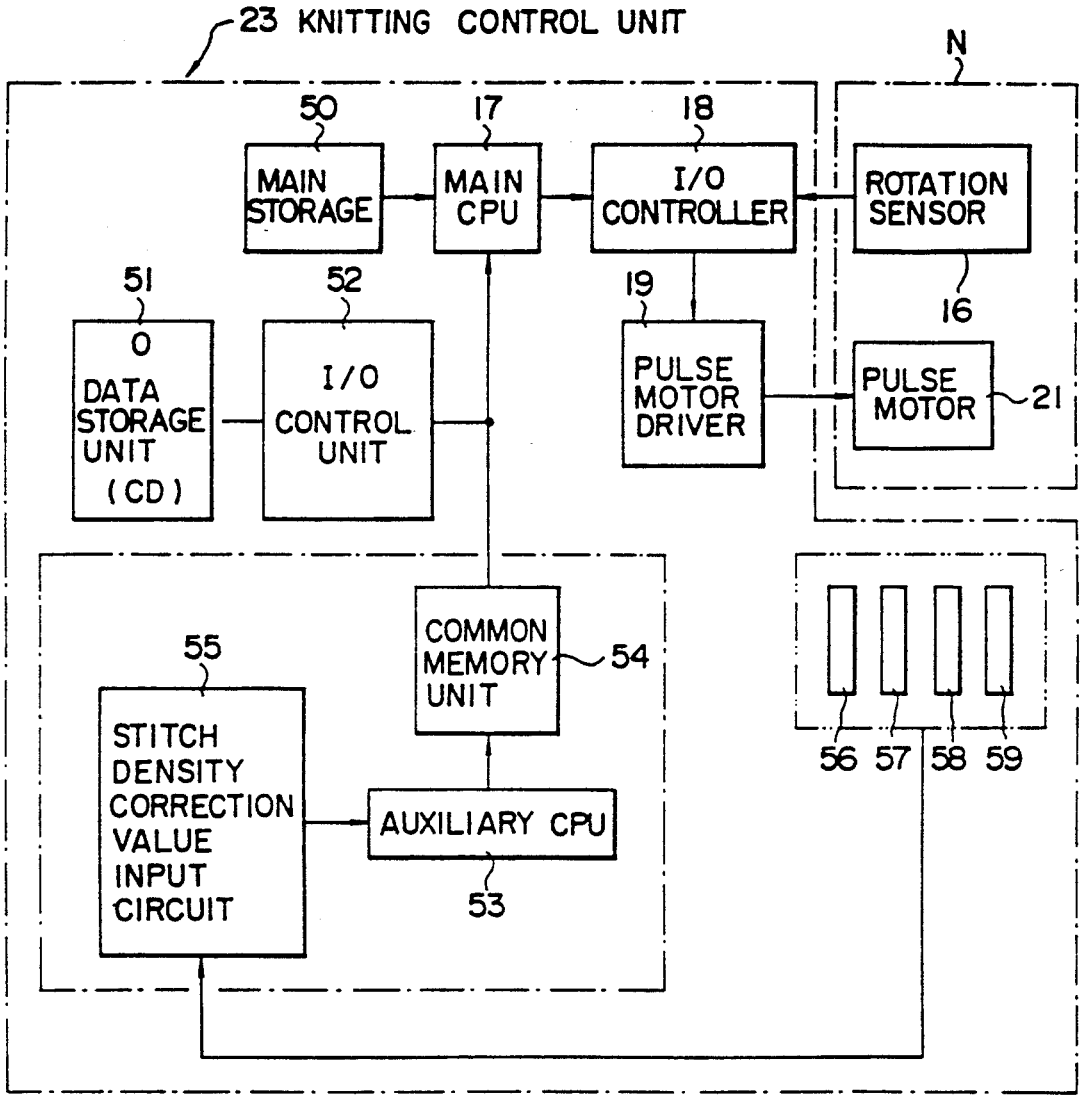
FIG. 3 is a block diagram explanatory of a knitting control unit used in the device shown in FIG. 1.

The knitting control unit 23 will be described below in more detail. Referring to FIG. 3, the knitting machine N has a rotation sensor 16 for detecting or counting the number of rotation of a shaft rotating in synchronism with the needle cylinder 3. The rotational number detected by the sensor 16 is used to count the number of courses knitted and the knitting operation shifts from one knitting region to the next knitting region when a predetermined number of rotation is detected. The above mentioned pulse motor 23 is shown in the block showing the knitting machine N. The speed sensor 16 is connected to a main central processing unit (CPU) 17 via an input-output (I/O) controller 18. The pulse motor 23 is controlled by the CPU 17 via the I/O controller 18 and a pulse motor driver 19.

To the CPU 17 is connected a main memory 50. A data storage means 51 using a floppy disk, for example, is connected to the CPU 17 via an input-output (I/O) control unit 52. The necessary programs are stored in the data storage means 51 and are supplied to the main CPU 17 through the I/O control circuit 52.

To the main CPU 17 is connected an auxiliary central processing unit (CPU) 53 via a common memory unit 54 to which is connected a stitch density correction value input circuit 55. To the circuit 55 are connected a knitting yarn sensor 56 for detecting the kind of the yarn, a knitting yarn tension sensor 57, a temperature sensor 58 and a humidity sensor 59. The circuit 55 stores standard data of the kind of the yarn, yarn tension, temperature and humidity and supplies the standard data to the auxiliary CPU 53. When changes occur to the kind of the yarn, yarn tension, temperature and humidity, they are detected by the sensors 56, 57, 58 and 59 and input to the correction value input circuit 55, which in turn supplies correction value to the auxiliary CPU 53 depending upon the detected values at the sensors.

The pulse motor 21 is controlled by the main CPU 17 based on the programs stored in the data memory unit 51. When any changes occur in the values detected by the sensors 56–59, these changes are reflected by correction values input to the auxiliary CPU 53 from the correction value input circuit 55. The signal from the auxiliary CPU 53 to the main CPU 17 causes a change in the control of the pulse motor 21.

The following is a description of the function of the stitch density adjusting device described above.

The predetermined fashioning cam 9 is mounted in advance on the shaft 20*a*, and knitting programs are input to the knitting control unit 23, the knitting programs including a standard program for knitting a panty hose W with a gradual change in circumference from the welt portion to the ankle portion, and a program allowing a free knitting in shape from the welt portion to the ankle portion.

When the operation of the circular knitting machine is initiated at its knitting start position, the pulse motor 21 is forwardly and reversely rotated in compliance with control signals transmitted from the knitting control unit 23 which stores the knitting programs. This allows the fashioning cam 9 to be slowly rotated forwardly and reversely by way of the output shaft 21*b* of the pulse motor 21, intermediate gear 22 and then the drive gear 20, thereby causing the stitch density adjusting lever 7 being in contact with the fashioning cam 9 to swing about the pivot 8. The abutting member 7*b* of the stitch density adjusting lever 7 in turn vertically raises and lowers the abutment piece 6*a* of the rising ring 6, whereby the rising ring 6 forces the needle cylinder 3 to vertically rise and fall with the aid of the bearing 2 and the rising pins 4 while rotating the needle cylinder through the bevel gear 5 by a drive source not shown. Thus, the panty hose W are selectively knitted as shown in FIGS. 7A, 7B and 7C while changing the density of the stitch of the yarn which is fed to the needles (not shown) on the needle cylinder 3.

Although the pulse motor 21 is shown in the embodiment, an ultrasonic motor, stepping motor, or servo motor may be used in lieu of the pulse motor 21.

Circular knitting machines provided with the stitch density adjusting device described above are nowadays operated at high-speed revolution of the needle cylinder 3 of the order of 200 to 1500 RPM for the purpose of improving the efficiency of knitting socks, panty hose and tights. This may adversely result in a problem that the needle cylinder 3 and its associated members are heated in continuous operation up to about 70° to 80° C. due to the frictional resistance between the needles of the needle cylinder 3 and cams in the knitting head, which may in turn bring about thermal expansion of the needle cylinder 3 of the order of 0.15 to 0.2 mm in its axial direction. As a result, socks, panty hose and tights knitted under these circumstances may possibly undergo elongation of the order of 10 to 15% of the standard knitting length which is set in the knitting program, which disadvantageously leads to an impaired quality and poor reliability of products thus knitted.

This problem can be overcome with the provision described below.

Referring again to FIG. 1, the frame 1 outside the needle cylinder 3 is provided with a knitting head 24 having therein known stretching cams and clearing cams. The knitting head 24 consists of an upper portion, for example, a sinker cap 24*a*, a middle portion, for example, a cam box 24*b*, and a lower portion, for example, a table support 24*c*, fitted respectively with temperature sensors 25*a*, 25*b* and 25*c* for detecting the temperatures of the needle cylinder 3, the needles 3*a* and the inside of the knitting head 24, respectively. The temperature sensors 25*a*, 25*b*, and 25*c* are connected to a temperature comparator 26 in which a setting temperature value is preset for a fine adjustment to cancel the thermal expansion of the needle cylinder 3 and the associated parts. The temperature comparator 26 is, in turn, connected to the yarn density control unit 23 through a line 27 for the transmission of detection signals.

The temperature comparator 26 compares the detected temperatures based on the signals from the temperature sensors 25*a*, 25*b* and 25*c* with the setting temperature value, and if any one of the detected temperature exceeds the setting temperature value the comparator 26 will transmit a signal corresponding to the difference in temperature between the detected temperature and the setting value, to the yarn density control unit 23 by way of the line 27.

The function will be described hereinbelow.

During the operation of the circular knitting machine, the temperature rise due to heat generated as a result of friction of the needle cylinder 3 and associated parts is detected by the sensors 25*a*, 25*b* and 25*c*. When any one or all of the detected temperatures of the sensors 25*a*, 25*b* and 25*c* exceed the temperature which has been set in the temperature comparator 26, the difference in temperature is input into the stitch density control unit 23 (the stitch density correction value input circuit 55 in FIG. 3) which executes a fine adjustment for raising and lowering the needle cylinder 3 by an amount needed to compensate for the thermal expansion by means of the pulse motor 21, in the manner as described before with reference to FIGS. 1 and 2. The temperature correction value is thus automatically used for adjustment to a standard knitting length which has been set by inputting a knitting width and a knitting length of the products to be knitted into the knitting program, thereby knitting the products having set length and width while changing the density of the stitches to be produced, to consequently prevent deviation of the size of the knitted fabric and improve the quality and reliability of the knitted products.

Figure 4:
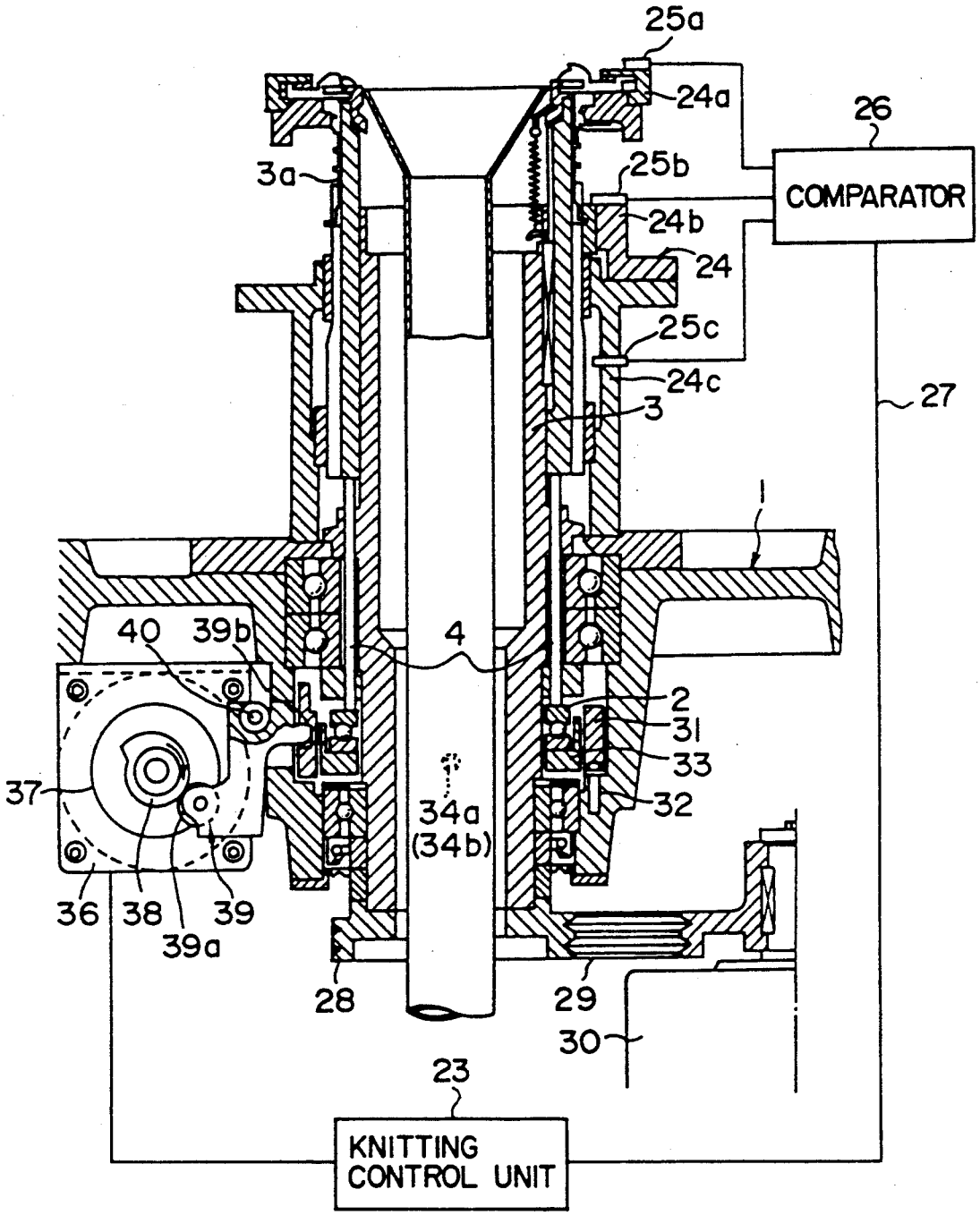
FIG. 4 is a fragmentary view, in vertical section, of a circular knitting machine with a stitch density adjusting device according to another embodiment of the present invention.
Figure 5:
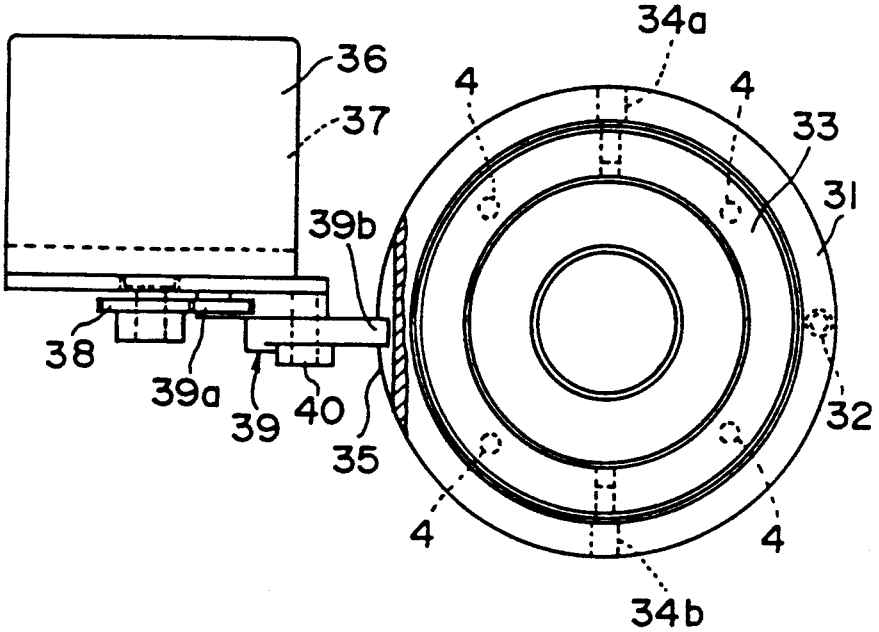
FIG. 5 is a plan view, partly in section, showing outer and inner rings, a stepping motor and other associated parts shown in FIG. 4.

Referring next to FIGS. 4 and 5, there is shown a more concrete embodiment of the invention for the execution of the temperature correction. This embodiment provides a compact stitch density adjusting device located in the lower portion of the needle cylinder.

With reference to FIG. 4, inside the frame 1 there is provided a rotatable needle cylinder 3 which is axially slidable through a slide key and has a multiplicity of needles 3*a* slidably fitted thereinto. The part of the frame 1 where the needles 3*a* rest has a knitting head 24 provided in such a manner that various cams provided therein vertically raise and lower the needles 3*a*. Moreover, the frame 1 has at its bottom a V-grooved pulley 28 which is coupled to a drive motor 30 by way of a V belt 29. Additionally, the frame 1 has at its lower portion an outer ring 31 loosely fitted so as not to fall out. The part of the frame 1 below the outer ring 31 is further provided with a vertically extending pivot pin 32 so as to support part of the outer ring 31. An inner ring 33 is fitted into the inside of the outer ring 31. The inner ring 33 has at its points spaced 90 degrees from the pivot pin 32 a pair of trunnions 34*a* and 34*b* (FIG. 5) intended to horizontally hold the inner ring 33. Furthermore, between the inner ring 33 and the lower portion of the needle cylinder 3 are interposed a bearing 2 and a plurality of (four in this embodiment) rising pins 4 partially passing through a cylinder sleeve. The rising pins vertically raise and lower the needle cylinder 3 for adjustment of the stitch density.

Referring to FIG. 5, there is provided a horizontally extending engagement groove 35 formed in the periphery of the outer ring 31 opposing the pivot pin 32. A part of the frame 1 at the side of the engagement groove 35 is provided with a mounting member 36 having the shape of an angle. The mounting member 36 is equipped with a stepping motor 37 having an output shaft with a substantially disk-like cam 38 mounted thereon. On the mounting member 36 in the vicinity of the cam 38 there is an operating lever 39 pivotally mounted on a pivot 40. The operating lever 39 is provided on one end thereof with a roller 39*a*, as clearly shown in FIG. 4, which is in contact with the cam 38. The operating lever 39 has an engagement claw 39*b* on the other end thereof which is engaged with the engagement groove 35.

The knitting head 24 incorporating stitch cams and clearing cams consists of an upper portion, for example, a sinker cap 24*a*, a middle portion, for example, a cam box 24*b* and a lower portion, for example, a table support 24*c*, correspondingly fitted with temperature sensors 25*a*, 25*b* and 25*c* which detect the temperatures of the needle cylinder 3, the needle 3*a* and the inside of the knitting head 24, respectively. The temperature sensors 25*a*, 25*b* and 25*c* are connected to a temperature comparator 26 which serves to preset a setting temperature value for the adjustment to cancel the thermal expansion due to the heat generation in and around the needle cylinder 3. The temperature comparator 26 is connected to a stitch density control unit 23 through a line 26 for the transmission of detection signals.

The temperature comparator 26 operates to compare the temperatures based on the detection signals transmitted from the respective temperature sensors 25*a*, 25*b* and 25*c* with the setting temperature value for the adjustment, and if any one or all of the detected temperatures exceed the setting temperature value the comparator 26 will transmit temperature difference signals to the stitch density control unit 23. The control unit 23 controls the stepping motor 37.

Accordingly, when the thermal expansion due to the frictional heat of the knitting cylinder 3 is detected by the temperature sensors 25*a*, 25*b* and 25*c* during the operation of the circular knitting machine, and any one or all of the thus detected temperatures exceed the temperature which has been preset, a temperature difference signal is transmitted to the stitch density control unit 23. Thus the stepping motor 37 rotating forwardly and reversely in response to the signal from the control unit 23 carries out a fine adjustment of vertically rising and falling movement of the needle cylinder 3 by the use of temperature correction values required to cancel the thermal expansion.

That is, when the stepping motor 37 rotates, the cam 38 is caused to rotate and causes the operating lever 39 to swing around the pivot 40, whereby the engagement claw 39*b* vertically displaces the outer ring 31 angularly with respect to the stationary pivot pin 32. The vertical angular movement of the outer ring 31 is transmitted to the inner ring 33 through the trunnions 34*a* and 34*b* so that the inner ring 33 is moved upwardly or downwardly while maintaining its horizontal attitude, whereby the needle cylinder 3 is also moved upwardly or downwardly via the bearing 2 and the rising pins 4 for adjustment of the stitch density.

Although a plurality of temperature sensors are used in the above embodiments, only a single sensor may be provided at a position having a highest temperature due to heat generation.

Figure 6:
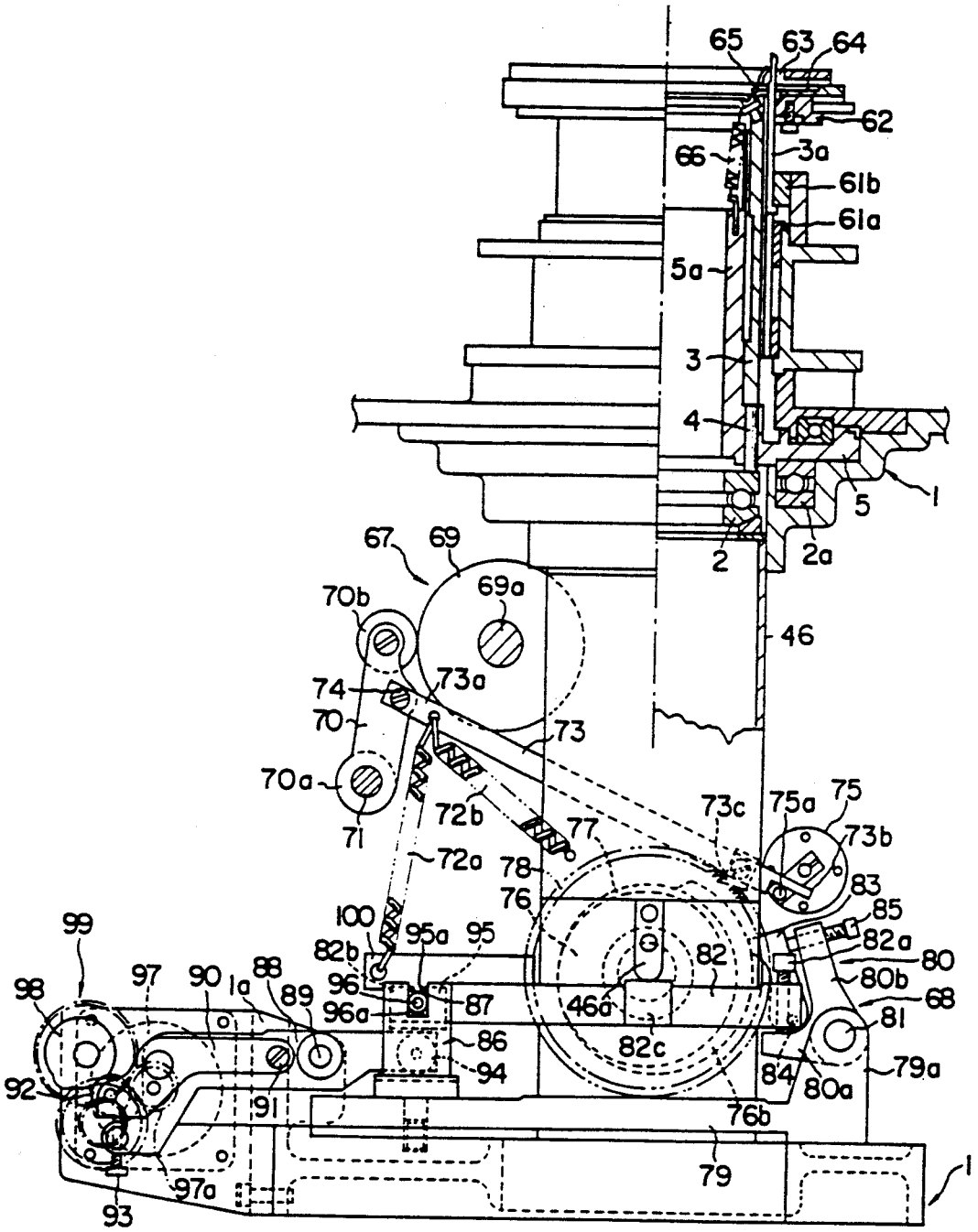
FIG. 6 is an elevation, partly in section, showing a further embodiment of the present invention.
Figure 7:
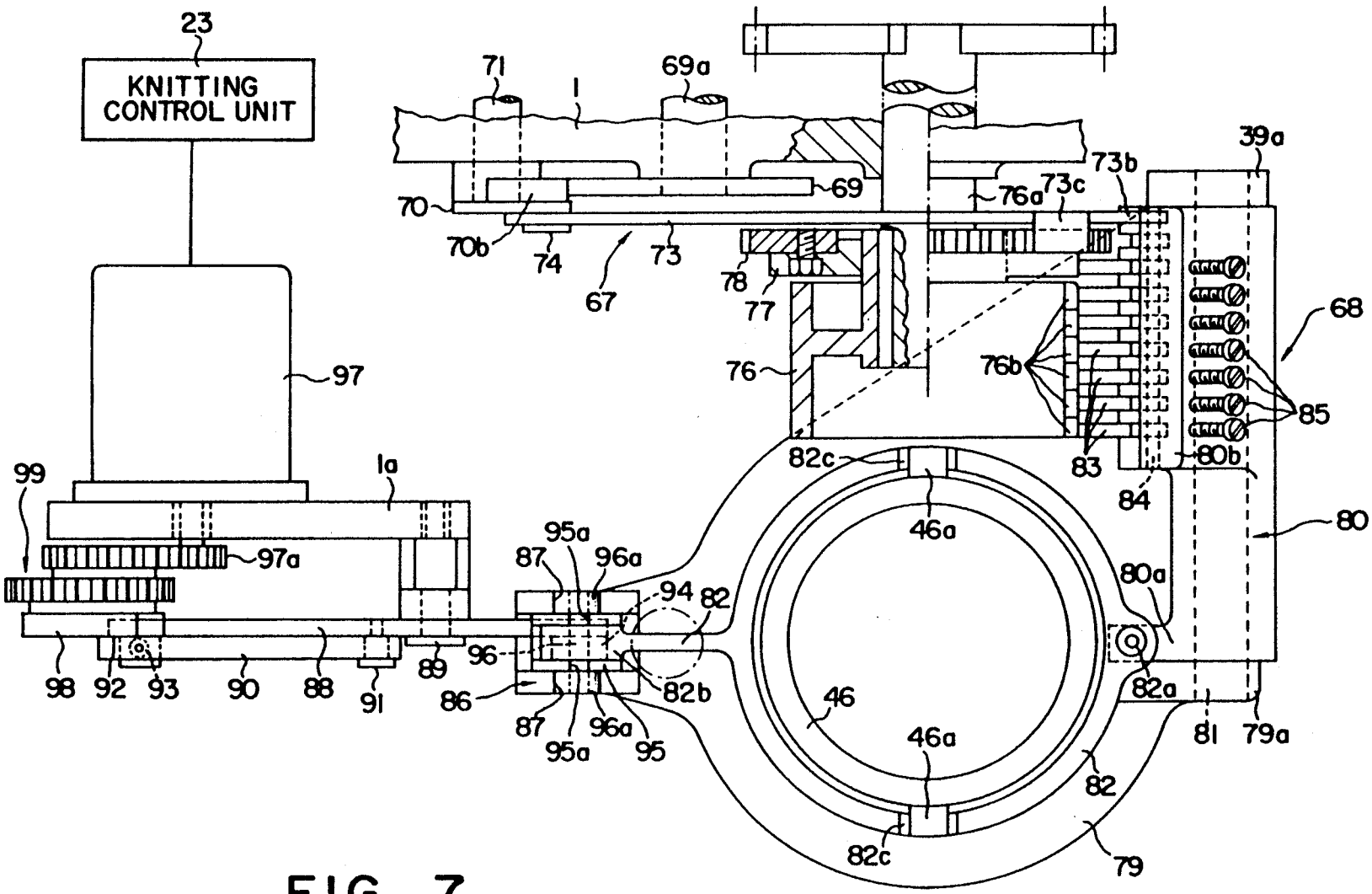
FIG. 7 is a plan view, partly in section, of the embodiment of FIG. 6.

FIGS. 6 and 7 shows a further embodiment of the present invention.

In FIG. 6, a machine frame 1 is provided with bearings 2 and 2*a*. A needle cylinder 3 is rotatably and vertically movably mounted on the bearing 2 via rising pins 4. A bevel gear 5 meshing with a power source operates to rotate the needle cylinder 3.

Beneath the bearing 2 is mounted a rising tube 46 which is movable upwardly and downwardly. At the lower end of the rising tube 46, there are fixed a pair of diametrically opposite engaging protrusions 46*a* extending in the vertical direction to rest on seats 82*c* which are supported, as shown in FIG. 7, on a ring-shaped rising member 82 to be described later. Knitting needles 3*a* are slidably mounted on the needle cylinder 3. On the inner side of a part of the machine frame 1 surrounding the knitting needles 3*a* are provided known cams 61*a* and 61*b* for moving in the vertical direction the butts of the respective knitting needles 3*a*. Furthermore, a sinker bed 62 is mounted in the horizontal direction above the needle cylinder 3, and on the upper surface of the sinker bed 62 are provided a number of radial guide slots (not shown) each receiving a sinker 63 which is slidable by a sinker cam 64 in the radial direction. A top cylinder 65 is provided on the top of the needle cylinder 3 for guiding respective sinkers 63. The top cylinder 65 together with the knitting cylinder 3 is urged downwardly by the force of coil springs 66 toward a cylindrical member 5*a* integral with the bevel gear 5.

As shown, a racking cam mechanism 67 and a fashioning cam mechanism 68 are provided on the machine frame 1 adjacent to the rising cylinder 46.

Racking Cam Mechanism (Intermittent Feed Mechanism)

As shown in FIG. 6, a known rotary racking cam 69 integral with a rotatable shaft 69*a* is supported by the machine frame 1 adjacent to the rising tube 46 to rotate in synchronism with the needle cylinder 3. A proximal portion 70*a* of a racking lever 70 is pivotally mounted at 71 on the machine frame 1 near the racking cam 69 in a swingable manner. A roller 70*b* is mounted on the free end of the racking lever 70 so as to be urged against the racking cam 69 by the force of coil springs 72*a* and 72*b*. One end 73*a* of a feed bar 77 is coupled to an intermediate point of the racking lever 70 by means of a pin 74. A feed claw 73*c* is connected to the other end 73*b* of the feed bar 77 such that a ratchet wheel 78 integral with the fashioning cam 77 is intermittently rotated by one tooth pitch.

A reversible actuator 75, for example a rotary solenoid, is mounted on a stationary mounting member (not shown) near the other end 73*b* of the feed bar 73. An engaging pin 75*a* is connected to the rotary output shaft of the reversible actuator 75 so as to raise the other end 73*b* of the feed bar 73 against the force of the springs 72*a* and 72*b* for disengaging the feed claw 73*c* from the ratchet wheel 78, thereby stopping the intermittent feed motion.

Fashioning Cam Mechanism

As shown in FIG. 7, on the machine frame 1 near the rising tube 46 is rotatably supported a horizontal rotary shaft 76a fixed to a drum 76 of the fashioning cam mechanism 68. The shaft 76a extends perpendicularly to the vertical axis of the rising tube 46. On the surface of the drum 76 are disposed a plurality (seven, in the embodiment shown) of cams 76b for stitch density adjustment. Various regions, shown in FIG. 9A, such as a welt portion e, a panty portion p, a garter portion g, a leg portion l, a toe portion t and so on of a stocking are knitted in accordance with these cams 76b and the fashioning cam 77 so as to have desired stitch densities. The fashioning cam 77 and the ratchet wheel 78 integral therewith are mounted to one side of the drum 76 near the feed claw 73c. The ratchet wheel 78 is intermittently fed by the feed claw 73c, as described hereinbefore.

As shown in FIG. 6, a horizontal supporting base 79 is provided on the machine frame 1 below the rising tube 46, and a pair of vertical lugs 79a are formed at one end of the supporting base 79. A bifurcated main body 80 of the stitch density adjusting device of the fashioning cam mechanism 68 is swingably mounted on the lugs 79a by means of a horizontal pivot pin 81. The ring-shaped rising member 82 abuts against a substantially horizontally projecting first arm 80a of the stitch density adjusting main body 80 through a screwed adjusting rod 82a. The rising member 82 supports on its seats 82c the engaging protrusions 46a provided on the rising tube 46 to raise and lower the tube 46 as the rising member 82 is raised and lowered. The stitch density adjusting main body 80 is formed also with a second arm 80b which extends upwardly but is slightly inclined toward the cams 76b of the fashioning drum 76. A plurality (seven, for example) of arm levers 83 are swingably pivoted to the base portion of the second arm 80b through a pin 84. The free ends of the six arm levers 83 abut on the cams 76b, respectively. Only the arm lever 83 located nearest to the ratchet wheel 78 abuts on the fashioning cam 77. Adjusting screws 85 for the respective arm levers 83 enable angular adjustment of these arm levers. Each of the cams 76b for the various knitting regions such as the welt portion e, panty portion p, garter portion g, toe portion t and so on acts on the associated arm lever 83 to swing the same, thereby to swing the first and second arms 80a and 80b. As a result, the rising tube 46 is raised or lowered through the rising member 82, for the adjustment of the stitch density of each knitting portion. When knitting a portion such as the leg portion l where there is a great change of the contour as shown in FIG. 9A, only the fashioning cam 77 is used for the adjustment of the stitch density. In this case, only the arm lever 83 associated with the fashioning cam 77 is acted upon by the cam 77 to cause swinging movement of the first and second arms 80a and 80b. During this period, the cams 76b do not act on the respective associated cam levers 83 because the cams 76b are cut out in the angular range in which the fashioning cam 77 operates. The cams 76b for the various knitting regions have mutually different angular operating range.

Stitch Density Fine Adjusting Mechanism

A sliding support 86 having substantially U-shaped cross section having two upright walls is fixed vertically on the horizontal supporting base 79 at the opposite side relative to the stitch density adjusting main body 80. At intermediate positions of the two upright walls of the sliding support 86 are formed opposite vertical slots 87, respectively. An auxiliary frame 1a (FIG. 7) is vertically secured to the machine frame 1 adjacent to the sliding support 86, the auxiliary frame 1a swingably supporting an adjusting lever 88 by means of a pin 89. An auxiliary lever 90 is pivotally secured at one end thereof to the adjusting lever 88 by means of a pin 91. A cam follower roller 92 is mounted at the other end of the auxiliary lever 90. A position adjusting screw 93 is provided at the end of the adjusting lever 88 at which the roller 92 is located. The adjusting screw 93 is used to angularly adjust the auxiliary lever 90 about the pin 91 relative to the adjusting lever 88 so that the position of the roller 92 on the adjusting lever 88 may be finely adjusted.

The other end of the adjusting lever 88 extends into the lower portion of the sliding support 86. A support roller 94 is pivotally mounted on the other end of the adjusting lever 88 to fit in the space between the two upright walls of the sliding support 86. A channel-shaped saddle 95 is placed on the support roller 94. The saddle 95 is loosely fitted in the space between the two upright walls of the sliding support 86. At intermediate positions of the two walls of the saddle 95 are formed opposite vertical slots 95a in registered relation with the slots 87 of the sliding support 86.

From the other end 82b of the rising member 82 project opposite horizontal rising pins 96 adapted to be raised and lowered in and along the slots 95a of the saddle 95 and the slots 87 of the sliding support 86. Each rising pin 96 supports thereon a roller 96a for rolling engagement with the slots 95a and 87.

Furthermore, as shown, to a rear side of the auxiliary frame 1a is mounted a pulse motor 97 operated by a knitting control unit 23 similar to the control unit 23 shown in FIG. 3. On the output shaft 97a of the pulse motor 97 is mounted a disk cam 98 having an involute contour. This cam 98 is adapted for engaging with and acting on the roller 92 of the auxiliary lever 90 through a reduction gear mechanism 99. Further, as shown in FIG. 6, a pair of braking plates 100 are mounted on both sides of the ratchet wheel 78 for applying a braking force to the wheel 78.

The mechanisms described above operates as follows.

Stitch Density Adjusting Operation

A predetermined fashioning cam 77 is selected and mounted. After mounting the cam 77 on the pin 76a, the machine is started with the cam 77 set in the knitting start position. Thereupon the ratchet wheel 78 is rotated stepwisely by the feed claw 73c of the feed bar 73 associated with the racking lever 70 driven by the racking cam 67 under the force of the coil springs 72a and 72b. Then the fashioning cam 77 integral with the ratchet gear 78 is rotated intermittently so as to cause the arm levers 83 contacting the cams 76b and the fashioning cam 77, respectively, to swing about the pin 84. As a result, the second arm 80b contacting the arm levers 83 is swung about the horizontal pivot pin 81 so that the first arm 80a is also swung in the same direction. The first arm 80a therefore pushes the rising member 82 upwardly through the threaded rod 82a, whereby the rising member 82 is swung upwardly about the rising pins 96. The rising member 82 therefore operates to elevate the rising tube 46 through the engaging protrusions 46a. As a consequence, the rising tube 46 moves the knitting cylinder 3 via the rising pins 4 in the vertical direction while the cylinder 3 is rotating on the bearings 2 and 2a. Thus the fashioning knitting of respective knitting regions is carried out while changing the stitch density of the yarn supplied by the knitting needles 3a.

Stitch Density Fine Adjusting Operation

When it is desired to finely adjust the stitch density throughout any knitting region such as the welt portion e, the panty portion p, the garter portion g, the leg portion l, or the toe portion t of a stocking, for example, the pulse motor 97 is operated by a knitting program in the knitting control unit 23 for pushing the roller 92 by the cam 98 rotatingly driven by the pulse motor 97, so as to turn the adjusting lever 88 about the pin 89, whereby the support roller 94 on the end of the adjusting lever 88 vertically moves the saddle 95 in the sliding support 86. Consequently, the rising pins 96 in the slots 95a of the saddle 95 are moved vertically under the guidance of the slots 87 of the sliding support 86. As a result, the rising member 82 is moved vertically, and the engaging protrusions 46a are acted upon by the rising member 82 whereby the rising tube 46 is moved in the vertical direction. The rising tube 46 moves the knitting cylinder 3 vertically for fine stitch density adjustment.

It will be noted that in addition to the stitch density adjustment carried out by the fashioning cam mechanism 68, a fine stitch density adjustment is carried out by the knitting control unit 23 through the pulse motor 97, cam 98, adjusting lever 88, saddle 95, rising pins 96 and rising member 82. Thus this embodiment is useful to delicately adjust the stitch density, enabling the exact production of knitted hose that fit the human's body very well. It is to be noted that in order to raise and lower the rising pins 96 by means of the pulse motor 97, any means other than the adjusting lever 88 may be used.

What is claimed is:

1. A stitch density adjusting device of a circular knitting machine having a needle cylinder, and a knitting head provided outside the needle cylinder, comprising:
rotatable fashioning cam means;
a rising member acted upon by the fashioning cam means so as to pivot on a rising pin in a manner to move the needle cylinder up and down for stitch density adjustment;
sliding support means for supporting said rising pin in a vertically shiftable manner;
motor means;
means operated by said motor means to adjustingly shift said rising pin vertically thereby to finely adjust the rising member in vertical position for fine adjustment of the stitch density;
an adjusting lever pivotally mounted at an intermediate position thereof and having one end driven by said motor means and the other end associated with said rising pin; and
said sliding support means comprising a sliding support of U-shaped cross section having two opposite side walls and receiving said other end of the adjusting lever slidably therein, and a saddle slidably received in said sliding support and resting on said other end of the adjusting lever so as to be slidingly shifted vertically when the adjusting lever pivots, said rising pin being carried by the saddle.

2. The stitch density adjusting device as set forth in claim 1, wherein said rising member is a ring-shaped member which support thereon a rising tube which in turn supports said needle cylinder.

3. The stitch density adjusting device as set forth in claim 2, wherein said ring-shaped rising member has two opposite seates at intermediate positions thereof, and said rising tube has two opposite engaging projections resting on said seats, respectively.

4. The stitch density adjusting device as set forth in claim 1, wherein said rising member has one end thereof acted upon by the fashioning cam means and an opposite end thereof supported through said rising pin by the sliding support means, said rising member having an intermediate portion for moving the needle cylinder up and down.

5. The stitch density adjusting device as set forth in claim 1, further comprising:
a cam rotatingly driven by said motor means, said one end of the adjusting lever being in driven contact with said cam.

6. The stitch density adjusting device as set forth in claim 5, further comprising:
an auxiliary lever pivotally supported on said adjusting lever adjacent to said one end of the adjusting lever;
means for adjustingly turn said auixliary lever relative to said adjusting lever; and
a cam follower mounted on said auxiliary lever at a position to be acted upon by said cam.

7. The stitch density adjusting device as set forth in claim 1, wherein said motor means is a pulse motor.

8. The stitch density adjusting device according to claim 1, wherein said saddle is channel-shaped and has opposite vertical slots in side walls thereof and said sliding support has also opposite vertical slots which are in registered relation with said slots of the saddle, said rising pin being in sliding engagement in said registered slots for free vertical shifting movement therein.

9. A stitch density adjusting device of a circular knitting machine having a needle cylinder, rotatable fashioning cam means, and a rising member acted upon by the fashioning cam means so as to pivot about a pivot pin (96) in a manner to move the needle cylinder up and down for stitch density adjustment, comprising:
sliding support means for supporting said pivot pin in a vertically shiftable manner;
motor means;
means operated by said motor means to adjustingly shift said pivot pin vertically thereby to finely adjust the rising member in vertical position for fine adjustment of the stitch density;
an adjusting lever pivotally mounted at an intermediate position thereof and having one end driven by said motor means and the other end associated with said rising pin; and
said sliding support means comprising a sliding support U-shaped cross section having two opposite side walls and receiving said other end of the adjusting lever slidably therein, and a saddle slidably received in said sliding support and resting on said other end of the adjusting lever so as to be slidingly shifted vertically when the adjusting lever pivots, said rising pin being carried by the saddle.

* * * * *